United States Patent [19]

Larin

[11] Patent Number: 4,976,111

[45] Date of Patent: Dec. 11, 1990

[54] CRYOGENIC CONDENSATION PUMP

[76] Inventor: Marxen P. Larin, prospekt Nauki, 29, kv. 78, Leningrad, U.S.S.R.

[21] Appl. No.: 415,295

[22] PCT Filed: Dec. 7, 1988

[86] PCT No.: PCT/SU88/00254

§ 371 Date: Sep. 7, 1989

§ 102(e) Date: Sep. 7, 1989

[87] PCT Pub. No.: WO89/06317

PCT Pub. Date: Jul. 13, 1989

[30] Foreign Application Priority Data

Jan. 8, 1988 [SU] U.S.S.R. ..... 4360458

[51] Int. Cl.[5] ..... B01D 8/00

[52] U.S. Cl. ..... 62/55.5; 55/269; 62/268; 417/901

[58] Field of Search ..... 62/55.5, 100, 268; 55/269; 417/901

[56] References Cited

U.S. PATENT DOCUMENTS

| | | | |
|---|---|---|---|
| 3,144,200 | 8/1964 | Taylor et al. | 62/55.5 |
| 3,256,706 | 6/1966 | Hansen | 62/55.5 |
| 3,263,434 | 8/1966 | Eder | 62/55.5 |
| 3,304,731 | 2/1967 | Bills et al. | 62/55.5 |
| 3,485,054 | 12/1969 | Hogan | 62/55.5 |
| 3,625,018 | 12/1971 | Roberts | 62/55.5 |
| 3,712,074 | 1/1973 | Boissin | 62/55.5 |
| 4,356,701 | 11/1982 | Bartlett et al. | 62/55.5 |

FOREIGN PATENT DOCUMENTS

| | | |
|---|---|---|
| 341968 | 7/1972 | U.S.S.R. . |
| 620658 | 8/1978 | U.S.S.R. . |
| 1017817 | 7/1981 | U.S.S.R. . |
| 1232841 | 12/1984 | U.S.S.R. . |

OTHER PUBLICATIONS

Obschaya Experimentalnaya Tekhnika

*Primary Examiner*—Ronald C. Capossei o

*Attorney, Agent, or Firm*—Lilling and Lilling

[57] ABSTRACT

The cryogenic condensation pump comprises a housing (3), accommodating a vessel (3) for a cryoagent, namely liquid nitrogen, a shell heat line and a chevron baffle which make up a radiation shield, and a pump-out element. The cryoagent vessel and pump-out element are provided with suspension pipes. Each of the suspension pipes is provided with assemblies, for joining it to the housing, and assemblies for joining it to the cryoagent vessel and the pump-out element.

The suspension pipe of the pump-out element is provided with a support bush, and in the cover of the cryoagent vessel an annular element is secured which makes contact with the support bush. The pump housing, radiation shield and pump-out element are made of metals having low specific weight.

5 Claims, 3 Drawing Sheets

CRYOGENIC CONDENSATION PUMP

FIELD OF THE INVENTION

The present invention relates to vacuum technology and more specifically to the designs of cryogenic condensation vacuum pumps. The best use of the invention may be made in vacuum technology widely employed in the electronic industry, radio engineering and other industries, as well as in those fields of research which need creating and maintaining, for a long time, an ultrahigh-purity, completely oil-free ultrahigh vacuum in the operating pressure range from $1\times10^{-4}$ to $1\times10^{-10}$ Pa.

DESCRIPTION OF THE PRIOR ART

At present, the improvement of cryogenic condensation pumps follows the path of optimization of their designs with the purpose to reduce their weight and metal consumption, simplify the processes of pump assembly and disassembly, and improve the pump efficiency.

Known in the art is a cryogenic condensation pump containing a housing, accommodating a radiation shield comprised of a vessel for a cryoagent, a shell heat line and a chevron baffle that are properly interconnected and a pump-out element in the form of a vessel. The vessel for the cryogent of the radiation shield and the pump-out element are provided with suspension pipes serving to fill said vessels with cryoagents, respectively, liquid nitrogen and liquid helium, as well as to secure the vessels in the housing (M. P. Larin, "Pribory i Tekhnika Eksperimenta", a journal of the Academy of Sciences of the USSR, Moscow, No. 2, 1982, pp. 130–133, cf. p. 132).

It is known that of primary importance in helium cryogenic condensation pumps is the problem of economically efficient consumption of liquid helium for reasons of its scarcity and high price. However, in the pump described, the pump-out element made of copper and filled with liquid helium experiences large heat inflows along a smooth-walled suspension pipe. Therefore, in the pump described, relatively high vaporability of the liquid helium exists, with the result that this pump design is not sufficiently economical.

Also known in the art is a cryogenic condensation pump containing a housing accommodating a radiation shield comprised of a vessel for a cryogent, a shell heat line and a chevron baffle that are properly interconnected, and a pump-out element in the form of a vessel (SU, A, 1017817). The pump-out element is in the form of a vessel and is located in the cavity formed by the bottom of the vessel for the cryoagent of the radiation shield, the surface of the shell heat line and the chevron baffle. The vessel for the cryoagent of the radiation shield and the pump-out element are provided with suspension pipes serving to fill said vessels with cryoagents, namely liquid nitrogen and liquid helium, respectively, as well as to secure these vessels in the housing. To reduce heat inflows to the pump-out element filled with liquid helium through a suspension pipe, the latter is made in the form of a corrugated metal tube with a helical corrugation profile. Suspension pipes are joined by welding to the vessel for the cryoagent of the radiation shield or to the pump-out element. To join the suspension pipes to the housing, their top ends are welded to the top ends of the housing branch pipes into which the suspension pipes are inserted. The pump housing and suspension pipes are made of stainless steel and the elements of the radiation shield, i.e., the cryoagent vessel, shell heat line and chevron baffle, as well as the pump-out element, of copper.

A disadvantage of this pump is that its assembly or disassembly presents difficulties, e.g., in repairs of the vessel for the cryoagent of the radiation shield or the pump-out element. In such cases, the top ends of suspension pipes and of housing branch pipes welded together must be cut and, upon completion of repair and subsequent reassembly of the pump, they must be rewelded so as to provide highquality welds of the pipe ends. These operations are labour- and time-consuming and require special conditions. Besides, pump elements of stainless steel and copper mean heavy weight and metal consumption, resulting in high stresses to the pump element and their weld joints and thus causing the danger of breaking-off, especially in transit.

It should also be noted that the pump described is not sufficiently economical on account of rather high consumption of cryoagents, i.e., liquid helium and liquid nitrogen, because of their evaporation due to large heat inflows to the pump-out element and the vessel for the cryoagent of the radiation shield.

SUMMARY OF THE INVENTION

The principal object of the present invention is to provide a cryoagenic condensation pump comprising a housing accommodating a radiation shield with a cryoagent vessel and a pump-out element in the form of a vessel, provided with suspension pipes and in which the suspension pipes are joined to the housing and the radiation shield vessel or to the pump-out element. The housing, radiation shield and pump-out element are made of such a material that assembly and disassembly of the pump become easier and simpler, the weight and the metal content of the pump are reduced and reliable vacuum-tight joints of pump elements are ensured.

With this principal object in view, there is proposed a cryogenic condensation pump comprising a housing accommodating a radiation shield comprised of a vessel for a cryoagent, a shell heat line and a chevron baffle that are properly interconnected, and a pump-out element in the form of a vessel, the vessel for a cryoagent of the radiation shield and the pump-out element being provided with suspension pipes. In accordance with the invention, every suspension pipe is provided at its opposite sides with assemblies for joining it to the housing and to the vessel for a cryoagent of the radiation shield or to the pump-out element. The suspension pipe-to-housing joining assembly contain a branch pipe located in a hole in the housing flange and hermetically secured with one of its ends on the suspension pipe, while at the other end of the branch pipe a collar is provided with an annular projection facing the housing flange, on which a matching annular projection is also provided, a sealing metal gasket being installed between said annular projections, while in the middle portion of said branch pipe an annular flange is secured, installed in which are stop bolts being in contact with the housing flange. The assembly for joining a suspension pipe to the vessel for a cryoagent of the radiation shield or to the pump-out element has a branch pipe with an end sealing collar hermetically joined to the neck of the vessel for a cryoagent of the radiation shield or the pump-out element and two flanges joined together with their end surfaces facing each other, one of which is hermetically attached at the end of a suspension pipe while the other is installed at the end of said branch pipe. The flanges are provided at their surfaces facing each other with annular projections. The end sealing collar of the branch pipe is located between the annular projections of said flanges. The suspension pipe of the pump-out element is provided with a support bush. In the cover of the vessel for a cryoagent of the radiation shield an annular element is secured being in contact with the support bush. The pump housing, radiation shield and pump-out element are made of metals having low specific weight.

The provision of each pipe with assemblies for joining it to the housing and to the vessel for a cryoagent of the radiation shield or to the pump-out element and executing these assemblies as described hereinabove facilitates and simplifies assembly and disassembly of the pump when repairing the vessel for a cryoagent of the radiation shield or the pump-out element as may be required, e.g., in order to redeposit aluminium film onto their surfaces. In disassembly of the pump, only the suspension pipe-to-housing joining assemblies are disassembled, whereupon all the inside units of the pump are set free from the housing. In assembling the units of the pump are mounted in a reverse order.

Said joining assemblies manufactured as described above provide a means to make the pump housing, radiation shield and pump-out element of a metal having low specific weight, e.g. the housing of titanium, the radiation shield and pump-out element of aluminium, which allows reduction in the weight and metal content of the pump.

Such a design of joining assemblies as described above ensures vacuum-tight connection of the pump housing made of titanium as well as of the radiation shield and the pump-out element made of aluminium with the suspension pipes made of stainless steel. Due to the presence of annular projections on the elements to be joined and of a sealing gasket between them made of a soft metal such as aluminium, tightening the joining assemblies ensures vacuum-tight connection of the housing made of titanium with a suspension pipe made of stainless steel and of the vessel for a cryoagent of the radiation shield or pump-out element made of aluminium with a suspension pipe made of stainless steel.

It is expedient that the contact surfaces of the support bush and annular element be made conical. Such a construction of the contact surfaces facilitates the process of dismantling the pump-out element in disassembly of the pump and provide for better thermal contact of the middle portion of the suspension pipe with the vessel for a cryoagent of the radiation shield upon reassembly.

It is advantageous to furnish suspension pipe of the the pump-out element, at the side adjacent to the pump-out element, with a shield coaxially installed and having thermal contact with the suspension pipe near the assembly for joining it to the pump-out element.

The presence of said shield reduces radiation heat inflow from the vessel of the radiation shield to the assembly for joining the suspension pipe with the pump-out element held at liquid helium temperature and to the lower portion of the suspension pipe whose temperature is close to liquid helium temperature. This reduces heat inflow by thermal conduction to the pump-out element itself from the suspension pipe and the assembly for joining it to the pump-out element, thus reducing the vaporability of the liquid helium in the pump-out element and hence enhances the economic efficiency of the pump.

It is advisable to provide the cryoagent vessel of the radiation shield with an additional shield installed between the housing and said vessel with a clearance. The presence of an additional shield reduces radiation heat inflow from the pump housing to the cryoagent vessel, which, in turn, reduces the vaporability of the cryoagent, namely the liquid nitrogen, and thus enhances the economic efficiency of the pump.

It is advisable that a bush with coaxial blind holes at its opposite sides be installed at the bottom of the pump-out element and that the chevron baffle have a hole coaxial with the holes of the bush.

The presence of said bush with holes provides a possibility to secure rigidly the pump-out element in the pump housing by means of rods inserted into said holes and properly secured therein, which ensures that the pump elements and assemblies and their welded joints are intact in transit.

BRIEF DESCRIPTION OF THE DRAWINGS

The invention will be further described in detail, using an example of carrying it into effect, with reference to the accompanying drawings, wherein.

DETAILED DESCRIPTION OF THE INVENTION

Figure 1:
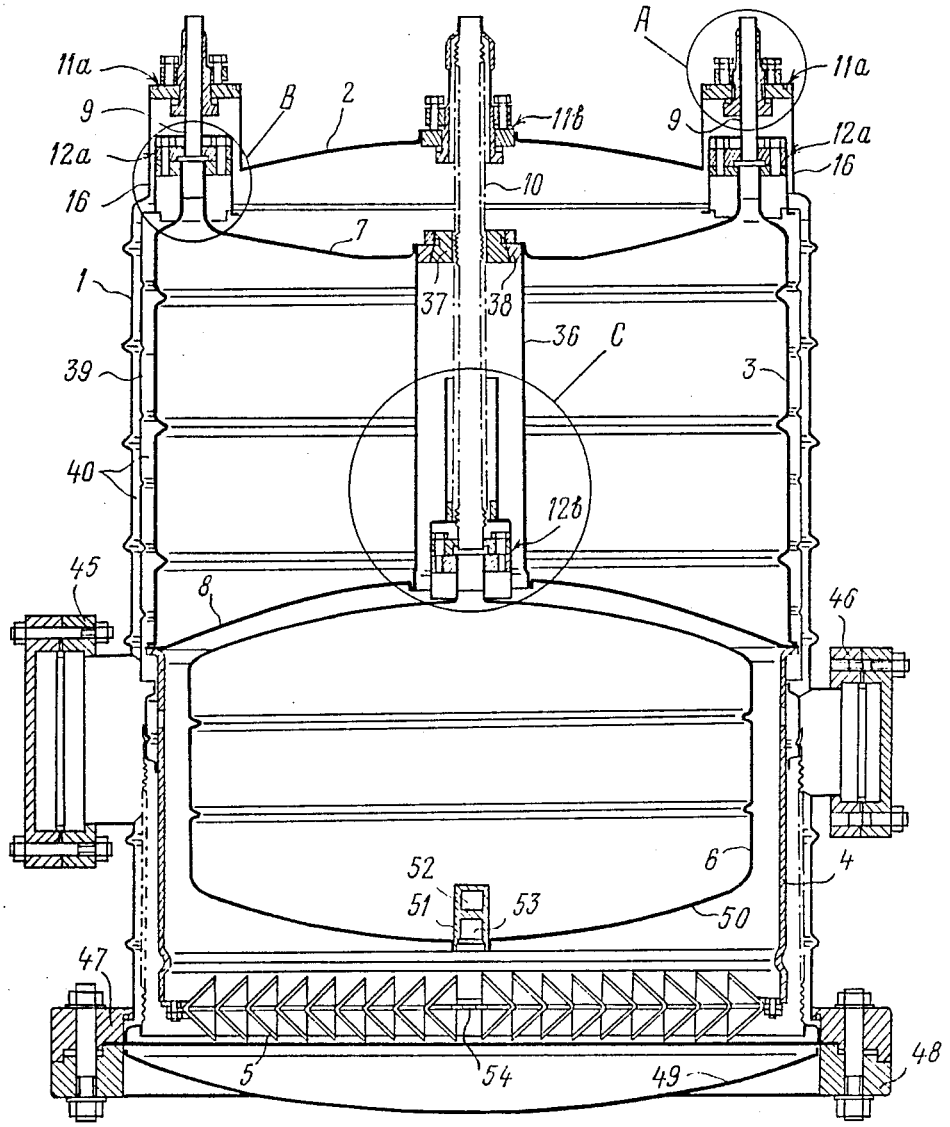
FIG. 1 is a sectional view of the cryogenic condensation pump, according to the invention.

The cryogenic condensation pump contains a housing 1 (FIG. 1) with a cover 2 accommodating a vessel 3 for a cryoagent, namely liquid nitrogen, a shell heat line 4 and a chevron baffle 5 which make up a radiation shield 3, 4, 5, and a pump-out element 6. The cryoagent vessel 3 has a cover 7 and a bottom 8. The pump-out element is made in the form of a vessel filled with a cryoagent, liquid helium, and is located in the cavity formed by the bottom 8 of the cryoagent vessel 3, the shell heat line 4 and the chevron baffle 5.

The cryoagent vessel 3 of the radiation shield 3, 4, 5 and the pump-out element 6 are provided with appropriate suspension pipes 9 and 10. The suspension pipe 9 has at its opposite ends assemblies 11*a* and 12*a* for joining it to the housing 1 and to the cryoagent vessel 3, respectively. The suspension pipe 10 also has at its opposite ends assemblies 11*b* and 12*b* for joining it to the housing 1 and to the pump-out element 6, respectively.

Figure 2:
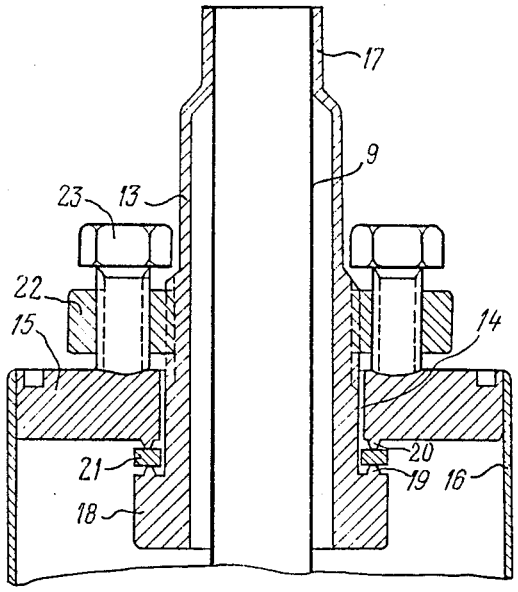
FIG. 2 is an enlarged sectional view of assembly A of FIG. 1.

The assembly 11*a* for joining the suspension pipe 9 to the housing 1 contains a branch pipe 13 (FIG. 2) located in a hole 14 of a flange 15 of the housing 1. The flange 15 is located inside a branch pipe 16 of the cover 2 of the housing 1 and is rigidly secured to the branch pipe 16 and thus to the housing 1.

One end 17 of the branch pipe 13 is hermetically fixed on the suspension pipe 9 while its other end has a collar 18 with an annular projection 19 facing the flange 15 of the housing 1, on which a matching annular projection 20 is provided. A sealing gasket 21 made of a soft metal, aluminium, is installed between the annular projections 19 and 20. In the middle portion of the branch pipe 13 an annular flange 22 is installed by thread connection. This flange is provided with threaded holes into which stop bolts 23 are inserted.

The assembly 11b for connecting the suspension pipe 10 to the housing 1 is made similarly to the assembly 11a for connecting the suspension pipe 9 to the housing 1 with the only difference that the flange 15 is secured directly to the cover 2 of the housing 1 and not shown separately to avoid complication of the drawings.

In the assemblies 11a and 11b for joining the suspension pipes 9 and 10, respectively, to the pump housing 1, tightening the stop bolts 23 ensures vacuum-tight connection of the housing 1 made of stainless steel due to the annular projections 19 and 20 on the surfaces facing each other, respectively, of the collar 18 and the flange 15 of the housing 1 and the sealing gasket 21 made of a soft metal, aluminium, arranged therebetween.

The assembly 12a for joining the suspension pipe 9 to the cryoagent vessel 3 of the radiation shield 3, 4, 5 contains a branch pipe 24 (FIG. 3) with an end sealing collar 25 hermetically joined to the neck 26 of the cryoagent vessel 3. The assembly 12a also has two flanges 27 and 28 facing each other by their end surfaces 29 and 30, respectively, and joined together by tie bolts 31. The flange 27 is hermetically fixed at the end of the suspension pipe 9, while the flange 28 is installed at the end of the branch pipe 24. The flanges 27 and 28 are provided, at their end surfaces 29 and 30, respectively, with annular projections 32 and 33, respectively, while an end sealing collar 25 is located between them.

The assembly 12a for joining the suspension pipe 9 to the cryoagent vessel 3 is provided with a shield 34 having a collar 35. The shield 34 reduces radiation heat inflow from the pump housing 1 to the assembly 12a.

Figure 3:
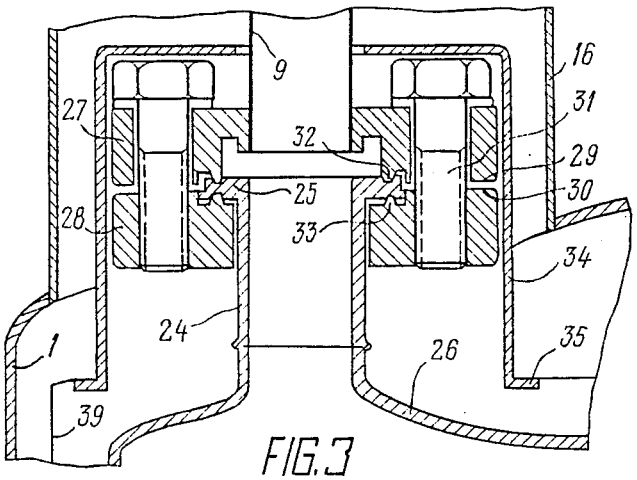
FIG. 3 is an enlarged sectional view of assembly B of FIG. 1.
Figure 4:
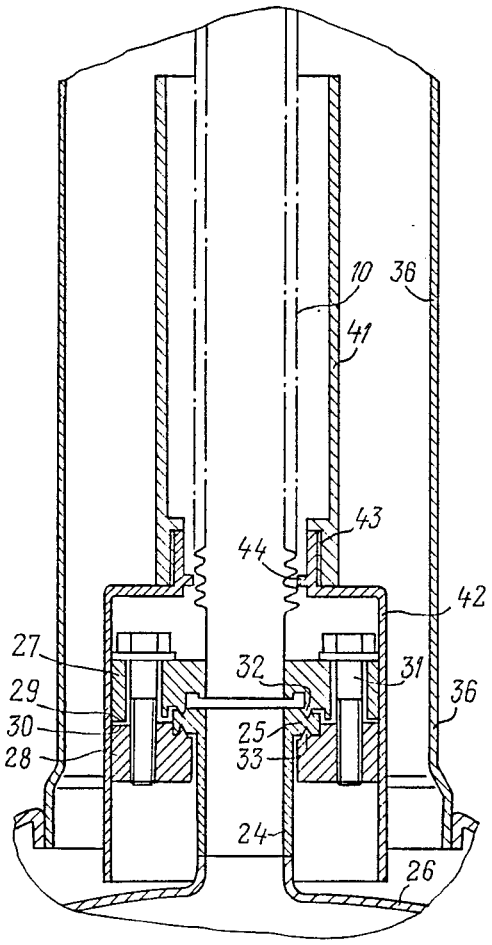
FIG. 4 is an enlarged sectional view of assembly C of FIG. 1.

The assembly 12b for joining the suspension pipe 10 to the pump-out element 6 is made similarly to the assembly 12a for connecting the suspension pipe 9 with the cryoagent vessel 3 and is shown in FIG. 4 where the respective elements are designated by the same reference numerals as in FIG. 3.

In the assemblies 12a and 12b for joining the suspension pipes 9 and 10 to the cryoagent vessel 3 and to the pump-out element 6, respectively, tightening the tie bolts 31 ensures vacuum-tight connection of the cryoagent vessel 3 or the pump-out element 6 which are made of aluminium to the suspension pipes 9, 10 made of stainless steel, due to the presence of projections 32 and 33 on the end surfaces 29 and 30 facing each other or the flanges 27 and 28 and the sealing collar 25 of a soft metal, aluminium, arranged therebetween.

The suspension pipe 10 of the pump-out element 6 passes through the cryoagent vessel 3 of the radiation shield 3, 4, 5 inside a cylinder 36 installed along the axis of the cryoagent vessel 3 and fixed in the cover 7 and bottom 8 of said vessel. The suspension pipe 10 is provided with a support bush 37 which is screwed onto the helical corrugations of the suspension pipe 10 while an annular element 38 which is in contact with the support bush 37 is fixed in the cover 7 of the cryoagent vessel 3. The contact surfaces of the support bush 37 and annular element 38 are made conical. Such a construction of the contact surfaces of the support bush 37 and annular element 38 facilitates the process of mounting and dismantling the pump-out element 6 in assembly and disassembly of the pump. Besides, this ensures better thermal contact of the suspension pipe 10 with the cryoagent vessel 3, thus reducing heat inflows by thermal conduction along the upper portion of the suspension pipe 10 from the pump housing 1.

The cryoagent vessel 3 is provided with an additional shield 39 installed between the housing 1 and the cryoagent vessel 3 with a clearance 40. The shield 39 is hung onto the collar 35 of the shield 34 (FIG. 3). The presence of this shield reduces radiation heat inflows from the pump housing 1 to the cryoagent vessel 3, which reduces the vaporability of the cryoagent, liquid nitrogen, and thus enhances the economic efficiency of the pump.

The suspension pipe 10 of the pump-out element 6 is provided, at its side adjacent to the pump-out element, with a coaxially installed shield (FIG. 4) consisting of two portions, the upper one 41 embracing the surface of the suspension pipe 10 at half its length and the lower one 42 protecting the assembly 12b for joining the suspension pipe 10 to the pipe-out element 6. The upper portion 41 and the lower portion 42 of the shield are joined together by thread 43. The shield has a thermal contact with the suspension pipe 10 in the vicinity of the joint to the pump-out element 6. Contact is made by means of a collar 44 provided on the lower portion 42 of the shield and engaging the helical corrugations of the suspension pipe 10.

The end of the suspension pipe 10 is directly joined by welding to the flange 27 of the assembly 12b for joining it to the pump-out element 6, and hence has a temperature close to the liquid helium temperature in the pump-out element 6 (4.2K). Due to the thermal contact of the suspension pipe 10 with the lower portion 42 of the shield, the temperature is kept at a value close to the liquid helium temperature along the shield. The temperature of the suspension pipe 10 varies from its end adjacent to the pump-out element 6 to the mid-length between 4.5K and 50K.

The presence of the shield reduces radiation heat inflow from the vessel 3 of the radiation shield to the assembly 12b for joining the suspension pipe 10 to the pump-out element 6 and to the lower portion of the suspension pipe 10. This reduces heat inflow by thermal conduction to the pump-out element 6 from the suspension pipe 10 and the assembly 12b for joining it to the pump-out element 6, thus reducing the vaporability of the liquid helium and enhancing the economoc efficiency of the pump.

The pump is provided with flanges 45, 46, 47 for connection to a booster high-vacuum pump, e.g., of the cold-cathode ion type, to a force-pump, e.g., of the sorption type, and the suction chamber (not shown in the figures to avoid complicating the drawings), and a blank flange 48 with a bottom 49 serving to carry the pump and test it alone, connected to itself.

In the bottom 50 of the pump-out element 6, along its axis, a bush 51 is fixed having, at its opposite ends, blind holes 52 and 53. In the chevron shield 5 there is provided a hole 54 coaxial with holes 52 and 53. In transit, inserted into the hole 52 is a rod which is passed through the suspension pipe 10 and is fixed to the branch pipe 13. Into the hole 53 is inserted a rod which is passed through the hole 54 in the chevron baffle 5 and is secured in the bottom 49 of the blank flange 48 (the rods are not shown in the figures to avoid complicating the drawings).

The bush 51 with holes 52, 53 provides a means to secure rigidly the pump-out element 6 using rods, which ensures that the elements and assemblies of the pump are intact in transit.

The pump housing 1 is made of titanium while the radiation shield comprised of the cryoagent vessel 3, the shell heat line 4 and the chevron baffle 5, and the pump-out element 6 are made of aluminium. This allows reduction in the weight and the metal content of the pump.

The cryogenic condensation pump operates as follows.

At the arrival of the pump, the blank flange 48 is removed, the lower rod is pulled out and a copper or aluminium plug is screwed into the hole 54. The pump is installed with the flange 47 on the matching flange of the suction chamber, the flanges being connected vacuum-tightly. The upper rod is pulled out. Then the plugs are removed from the flanges 45 and 46, and a cold-cathode ion pump is connected to the flange 45, while a valve with a metal seal is connected to the flange 46. Through this valve, a fore-pump system consisting of a mechanical fore-pump and a sorption pump is connected to the pump. The space to be evacuated in the proposed pumped and the suction chamber are first pump down to a pressure of 100 to 40 Pa by the mechanical fore-pump, and then down to a pressure of $1\times10^{-2}$ to $1\times10^{-4}$ Pa by the sorption pump.

Thereupon, the cryoagent vessel 3 is filled with liquid nitrogen through one of the suspension pipes 9. Once the pressure in the pump has been reduced by an order of magnitude, the cold-cathode ion pump is switched on and the pressure in the pump is reduced by another order of magnitude or two.

Now, it is expedient to preheat the suction chamber to 200° to 250° C., taking care that its pressure does not rise above $1\times10^{-4}$ Pa. As a result of such a four-to-eight hours heating of the suction chamber its pressure, upon cooling, usually falls down to $1\times10^{-6}$ to $1\times10^{-7}$ Pa.

Next, to save liquid helium, the pump-out element 6 is cooled down using a small quantity of liquid nitrogen from 1 to 2 l, to a temperature of 80 to 100K, by filling it through the suspension pipe 10. In so doing, the temperature may be monitored by a thermo-couple immersed along the suspension pipe 10 down to the bottom of the pump-out element 6.

Upon completing this operation, the cavity of the pump-out element 6 should be evacuated, through the suspension pipe 10, by the mechanical fore-pump down to a pressure of 100 to 40 Pa, and the pump-out element 6 should be filled with gaseous helium and then with liquid helium. As a result, the pressure in the suction chamber usually falls down to $1\times10^{-7}$ to $1\times10^{-9}$ Pa or even below. Next, the branch pipe 13 is connected to the gaseous helium collect system. The pump thus prepared is used to evacuate the suction chamber down to a required pressure.

Industrial Applicability

The present invention may be used to best advantage in vacuum technology widely employed in the electronic industry, radio engineering and other industries, as well as in those fields of research which need creating and maintaining, for a long time, an ultrahigh-purity, completely oil-free ultra high vacuum in the operating pressure range from $1\times10^{-4}$ to $1\times10^{-10}$ Pa.

What is claimed:

1. A cryogenic condensation pump comprising a housing made of a metal having low specific weight; a radiation shield accommodated in said housing, made of a metal having low specific weight and comprised of a cryoagent vessel, a shell heat line and a chevron baffle properly interconnected; a pump-out element in the form of a vessel made of a metal having low specific weight and located in a cavity defined by a bottom of said cryoagent vessel, said shell heat line and said chevron baffle; first and second suspension pipes connected, respectively, to the cryoagent vessel and the pump-out element;

assemblies for joining said first and second suspension pipes to said housing, each of said assemblies comprising a flange on said housing with an annular projection; a branch pipe located in a hole in said flange in said housing and having a first end hermetically secured on said suspension pipe; a collar provided on a second end of said branch pipe and having an annular projection facing the flange on said housing and said annular projection matching said annular projection on said flange of said housing; a sealing metal gasket installed between said annular projections of said collar and said flange of said housing; an annular flange secured in a middle portion of said branch pipe; and stop bolts installed in said annular flange in said middle portion of said branch pipe and said stop bolts being in contact with said flange of said housing;

assemblies for joining said first and second suspension pipes to the cryoagent vessel or to the pump-out element, each assembly comprising a branch pipe having an end sealing collar hermetically joined to a neck of the cryoagent vessel or the pump-out element; first and second flanges joined together and having end faces facing each other, said first flange being hermetically attached at a second end of the suspension pipe and the second flange being installed at a end of said branch pipe, the surfaces of said flanges facing each other being provided with annular projections and said end sealing collar being located between the annular projections of said flanges;

a support bush provided on the surface of said second suspension pipe; and an annular element in contact with said support bush and being fixed in a cover of said cryoagent vessel.

2. A pump as claimed in claim 1 wherein contact surfaces of the support bush and the annular element are made conical.

3. A pump as claimed in claims 1 or 2 wherein the second suspension pipe of the pump-out element is provided, at the side adjacent to the pump-out element, with a coaxially installed shield having thermal contact with the second suspension pipe in the vicinity of the assembly for joining it to the pump-out element.

4. A pump as claimed in claim 1 wherein the cryoagent vessel of the radiation shield is provided with an additional shield installed between the housing and said cryoagent vessel with a clearance between them.

5. A pump as claimed in claim 1 further comprising, in a bottom of the pump-out element, along its axis, a bush with coaxial blind holes at its opposite ends, and wherein in the chevron baffle a hole is made coaxial with the holes in the bush in the bottom of said pump-out element.

* * * * *